United States Patent [19]

Marciniak

[11] 4,164,159

[45] Aug. 14, 1979

[54] APPARATUS FOR FEEDING SIGNATURES FROM A SADDLE TO A TRIMMER

[75] Inventor: John J. Marciniak, Berea, Ohio

[73] Assignee: Harris Corporation, Cleveland, Ohio

[21] Appl. No.: 863,315

[22] Filed: Dec. 22, 1977

[51] Int. Cl.[2] ..... B65H 5/00

[52] U.S. Cl. ..... 83/280; 83/268; 83/278; 83/419; 83/420; 83/422; 83/423; 83/435.2

[58] Field of Search ..... 83/422, 423, 419, 420, 83/280, 278, 268; 270/53, 54; 198/644

[56] References Cited

U.S. PATENT DOCUMENTS

| | | | |
|---|---|---|---|
| 1,287,334 | 12/1918 | Kast | 270/53 |
| 1,706,366 | 3/1929 | Swift, Jr. | 83/423 X |
| 1,868,707 | 7/1932 | Hothersall | 83/423 X |
| 2,917,168 | 12/1959 | Faeber | 198/644 X |
| 3,087,721 | 4/1963 | McCain | 198/644 X |
| 3,148,574 | 9/1964 | Heigl et al. | 83/560 |
| 3,317,026 | 5/1967 | Zugel et al. | 198/644 X |
| 3,811,350 | 5/1974 | Marciniak | 83/268 |
| 4,076,232 | 2/1978 | Kistner et al. | 270/54 |

*Primary Examiner*—Frank T. Yost

[57] ABSTRACT

An improved apparatus for feeding signatures from a saddle to a trimmer mechanism includes a transfer apparatus which moves each signature in turn from the saddle onto a conveyor assembly at a delivery station. The conveyor assembly includes a plurality of chains having pusher fingers which engage the trailing edges of the signatures. The pusher fingers move the signatures into the trimmer mechanism. The pusher fingers on the conveyor assembly are registered relative to a stop in the trimmer mechanism to at least partially register the signatures before they enter the trimmer mechanism. The transfer assembly, which moves the signatures from the saddle to the conveyor assembly, is effective to positively grip each signature in turn by applying a clamping force to opposite sides of the signature. These clamping forces are continuously applied to the signature from the time it leaves the saddle until it is deposited on the conveyor assembly where it is engaged by the pusher fingers. This prevents twisting and jamming of the signatures in the transfer assembly and/or at the entrance to the conveyor assembly.

10 Claims, 7 Drawing Figures

APPARATUS FOR FEEDING SIGNATURES FROM A SADDLE TO A TRIMMER

BACKGROUND OF THE INVENTION

The present invention relates to a new and improved apparatus for use in moving signatures from a saddle to a trimmer.

Signatures have previously been moved from a saddle to a trimmer by moving the signatures upwardly from the saddle onto conveyor belts or tapes. The conveyor belts transport the signatures to a chain conveyor which transports the signatures to the trimmer. One known apparatus for use in transferring signatures from a saddle to conveyor belts or tapes is disclosed in U.S. Pat. No. 2,917,168.

During high speed operation of a signature handling apparatus, difficulties have been encountered in using conveyor belts or tapes to transport the signatures. Due to the relatively high speeds at which the signatures are traveling and the fact that the belts are ineffective to positively grip or clamp the signatures, the signatures can move relative to the belts. This may result in jamming of the signatures on the belts and at the position where the signatures are engaged by the pusher fingers on the chain conveyor.

SUMMARY OF THE PRESENT INVENTION

The present invention provides a new and improved signature handling apparatus which can be operated at very high speeds to transport signatures from a saddle to a trimmer mechanism without jamming due to twisting or slippage of the signatures. The apparatus includes a transfer assembly which is effective to transfer a signature directly from a saddle to a chain conveyor without the use of belts or tapes to transport the signature. In order to prevent slippage or twisting of the signatures, the transfer apparatus positively grips the signatures by applying a clamping force to opposite sides of each signature in turn as soon as it begins to leave the saddle. The signature is continuously gripped with a clamping force which is applied to opposite sides of the signature until the signature is deposited on the chain conveyor. The chain conveyor has pusher fingers which engage the trailing edge of the signature and push it to the trimmer mechanism.

The transfer of the signature to the chain conveyor takes place directly above the saddle. This minimizes the distance through which the signature must be moved with a resulting reduction in the chances for signature slippage to occur as the signature is transferred from the saddle to the chain conveyor. The chain conveyor has upper and lower runs or path lengths which are interconnected by an arcuate connector run or path length. This connector path length is disposed directly above the saddle.

As a signature leaves the saddle, it is positively gripped by rotatable feed members and moved along the connector path length onto the upper run of the chain conveyor. The trailing edge of the signature is then engaged by a pusher finger which moves the signature along the upper run of the chain conveyor to the trimmer mechanism. As the signature moves along the upper run of the conveyor, the signature is preregistered relative to the trimmer mechanism to thereby tend to minimize the extent to which the signature must subsequently be moved to register it with knives in the trimmer mechanism.

Accordingly, it is an object of this invention to provide a new and improved apparatus which can be operated at high speeds to transfer signatures from a saddle to a trimmer mechanism.

Another object of this invention to provide a new and improved apparatus for sequentially transferring signatures from a saddle to a conveyor assembly which transports the signatures to a trimmer mechanism and wherein the signature transfer apparatus is effective to grip a signature and move it upwardly while maintaining a clamping force against opposite sides of the signature to prevent undesired movement of the signature.

Another object of this invention is to provide a new and improved apparatus for transferring signatures from a saddle to a conveyor assembly and wherein a portion of the conveyor assembly is disposed directly above the saddle so that the signatures can be readily transferred from the saddle to the conveyor assembly.

BRIEF DESCRIPTION OF THE DRAWINGS

The foregoing and other objects and features of the present invention will become more apparent upon a consideration of the following description taken in connection with the accompanying drawings wherein.

DESCRIPTION OF A SPECIFIC PREFERRED EMBODIMENT OF THE INVENTION

Figure 1:
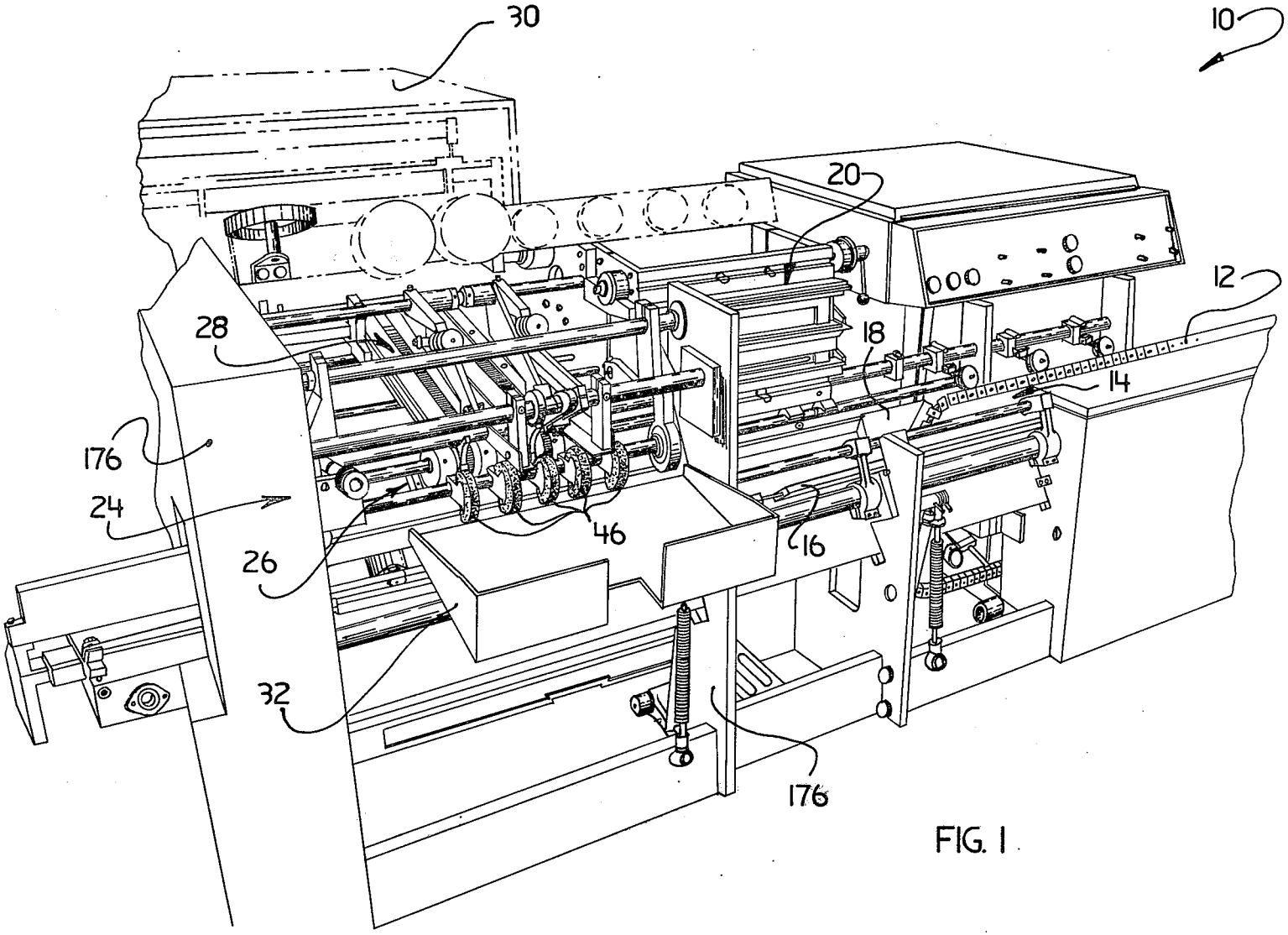
FIG. 1 is a pictorial illustration of a signature handling apparatus having a transfer assembly constructed in accordance with the present invention to move signatures from a saddle to a conveyor assembly leading to a trimmer.

A signature handling apparatus 10 constructed in accordance with the present invention is illustrated in FIG. 1. The signature handling apparatus 10 includes a conveyor 12 onto which fold sheets of material are fed from hoppers in a manner similar to that disclosed in U.S. Pat. No. 3,317,026 to form signatures. The conveyor 12 is effective to sequentially move the signatures to a pick-up station 14 where they are engaged by a shuttle assembly 16 and moved along a saddle 18 to a stitching station 20. After the signatures have been stapled or stitched at the station 20, the shuttle assembly 16 is effective to move the signatures along the saddle 18 to a delivery or trimmer inlet station 24.

At the delivery station 24, a transfer assembly 26 is effective to transfer the signatures to either a conveyor assembly 28 leading to a trimmer mechanism 30 or to a reject bin 32. In accordance with a feature of the present invention, the transfer assembly 26 is constructed so as to minimize twisting, slippage, and other undesired movement of the signatures that are sequentially transferred from the saddle 18 to the conveyor assembly 28 during high speed operation of the signature handling apparatus 10.

Figure 2:
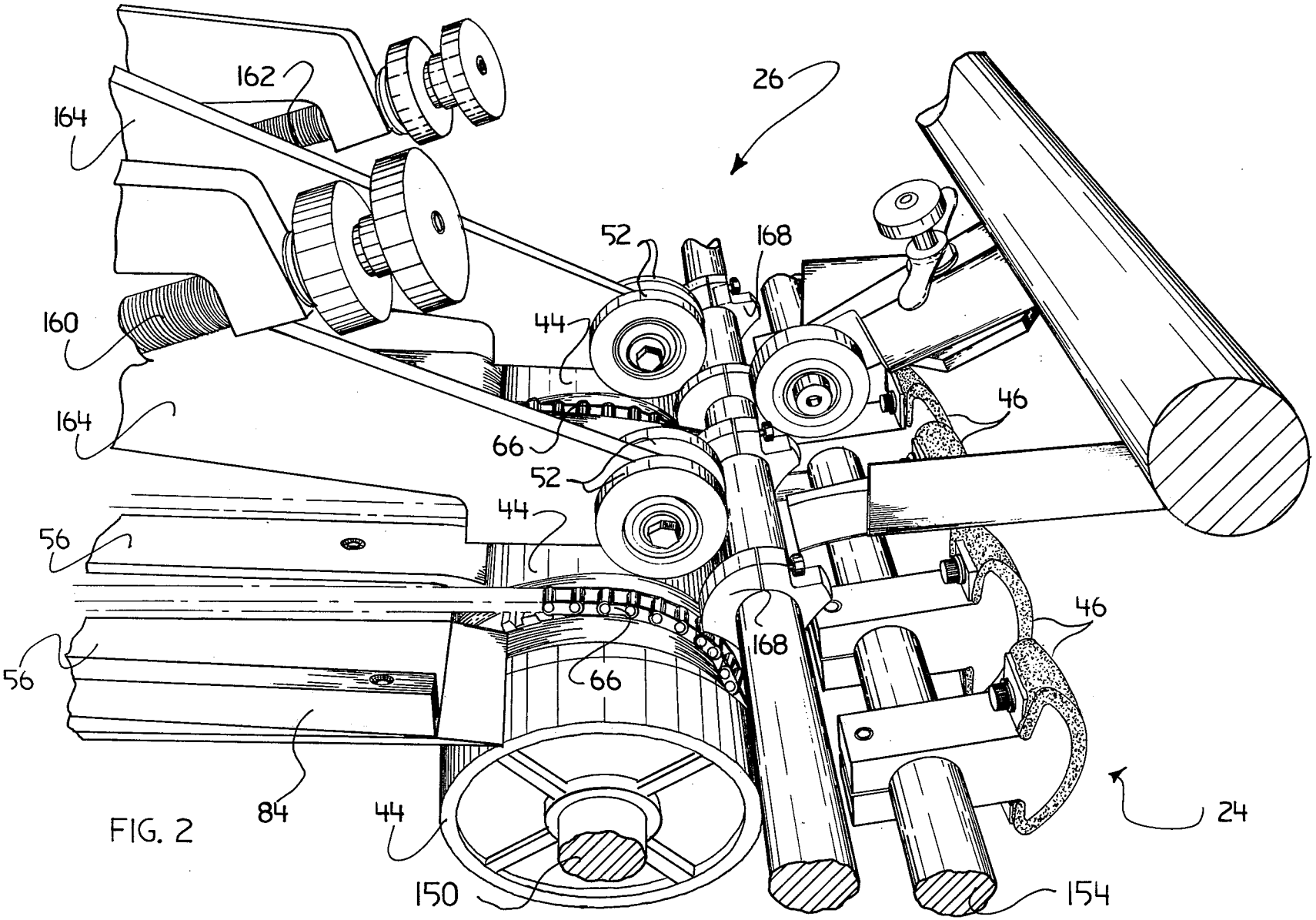
FIG. 2 is an enlarged pictorial illustration depicting the relationship between the transfer assembly and the conveyor assembly.
Figure 3:
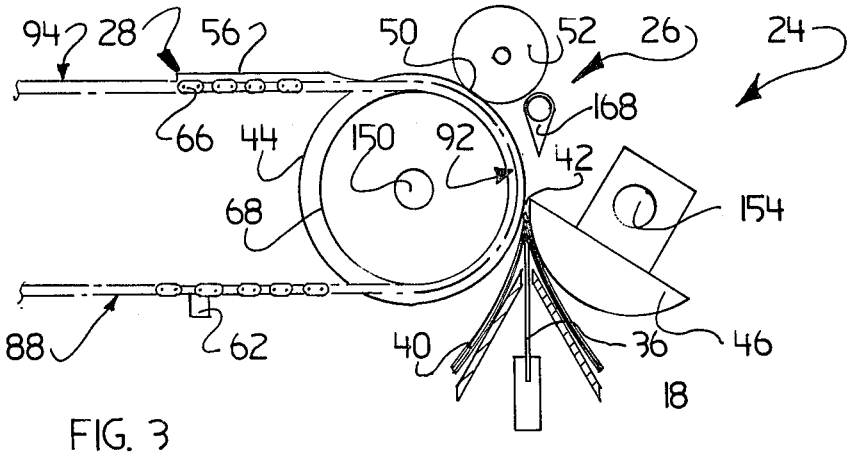
FIG. 3 is a schematic illustration depicting the manner in which a signature is moved upwardly from a saddle to a nip between a feed roll and a roll segment which are effective to apply clamping force to opposite sides of the signature.
Figure 4:
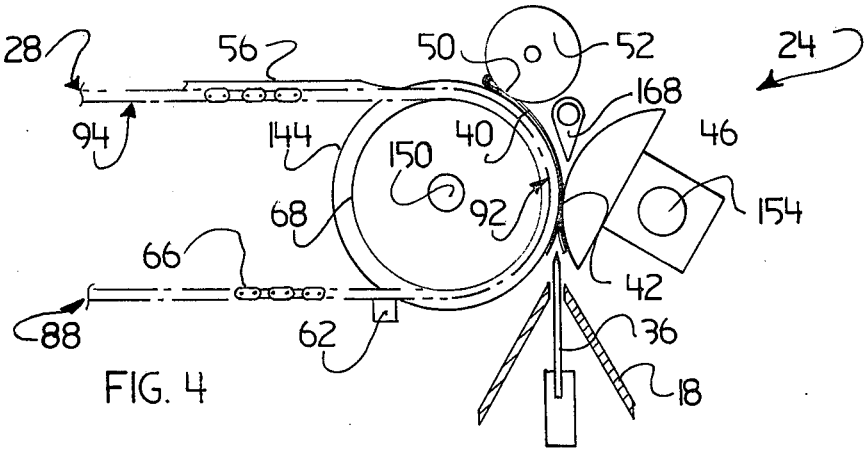
FIG. 4 is a schematic illustration, generally similar to FIG. 3, further depicting the manner in which clamping forces are applied to opposite sides of the signature.

The transfer assembly 26 (FIG. 3) includes tucker or lift blade 36 which is moved from a retracted position (FIG. 5) inside the saddle 18 to an extended position (FIG. 3). As the tucker blade moves upwardly to the extended position of FIG. 3, it raises the folded edge portion of a signature 40 upwardly into a nip 42 formed between a plurality of cylindrical feed rollers 44 and a plurality of rotatable roll segments 46 (see FIGS. 2 and 3). The roll segments 46 cooperate with the feed roller 44 to apply a clamping force to opposite sides of the signature to firmly grip the signature 40 and move it upwardly toward a second nip 50 formed between a plurality of presser rolls 52 and the feed rollers 44. The presser rolls 52 and feed rollers 44 are also effective to apply a clamping force to opposite sides of the signature to grip the signature as it moves away from the saddle 18.

Figure 5:
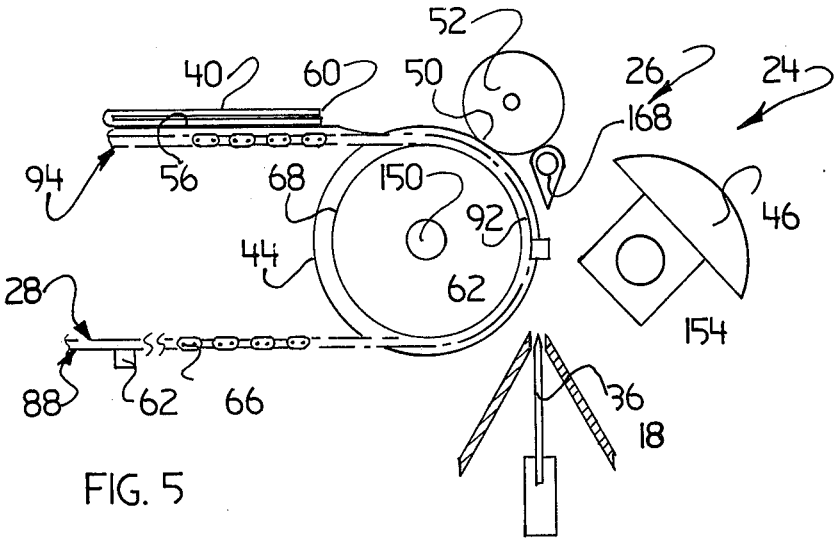
FIG. 5 is a schematic illustration, generally similar to FIGS. 3 and 4, depicting manner in which a signature is deposited on a chain conveyor assembly where it is engaged by a pusher finger and moved to a trimmer mechanism.

Continued rotation of the feed roller 44 moves the signature 40 onto generally horizontal support plates 56 (see FIG. 5). As the signature 40 moves onto the support plates 56, it decelerates until a trailing edge portion 60 of the signature is engaged by a pusher finger 62 of a conveyor assembly 28. The pusher finger 62 is effective to move the signature along a path extending to the inlet to the trimmer mechanism 30. The trimmer mechanism 30 is then operated to trim the edge portions of the signature. Although it is contemplated that the trimmer mechanism 30 could have many different constructions, the trimmer mechanism is advantageously constructed in the manner disclosed in U.S. Pat. No. 3,811,350.

In order to effect movement of the pusher fingers 62 to move the signatures from the delivery station 24 to the trimmer 30, the conveyor assembly 28 includes a plurality of continuous chains 66 (see FIGS. 2–5) which are connected with the pusher fingers 62. The chains 66 extend around sprockets 68 which are disposed in a coaxial relationship with the feed rollers 44 at the delivery station 24. The chains also extend around sprockets 70 (see FIGS. 6 and 7) disposed adjacent to the inlet to the trimmer mechanism 30. Suitable drive sprockets 72 are effective to drive the chains 66 to move the pusher fingers 62 along a circuitous path from the delivery station 24 to the trimmer 30 and then back to the delivery station.

When a pusher finger 62 has moved a signature 40 from the delivery station to the inlet to the trimmer mechanism 30, the pusher finger 62 is effective to push the folded leading edge portion of the signature into a nip formed between a pair of belts 76 and 78 (FIG. 6) in the trimmer mechanism 30. The belts 76 and 78 grip the signature and move it into engagement with a stop or register element 80 in the manner disclosed in the aforementioned U.S. Pat. No. 3,811,350.

The pusher fingers 62 are aligned in a registered relationship with the register member 80 in the trimmer 30. Therefore, engagement of the pusher fingers 62 with the trailing edges of the signatures is effective to at least partially register the signatures with the trimmer register member 80 before the signatures enter the trimmer. During high speed operation of the trimmer mechanism 30, this preregistering of the signatures is important since minimal movement of the signatures is required to register it in the trimmer mechanism 30. It should also be noted that side register guides or members 84 (see FIG. 2) are provided in association with opposite sides of the conveyor 28 to side register the signatures before they enter the trimmer 30.

After a signature has been transferred from the conveyor assembly 28 to the trimmer mechanism 30, the conveyor chains 66 are effective to move the pusher fingers 62 along a lower run or path length 88 (see FIG. 6) which extends from the sprocket 70 to the sprocket 68. The pusher fingers 62 then move into an arcuate and upwardly extending connector run or path length 92 (FIGS. 5 and 6) which extends around the sprocket 68 and connects the lower run or path length 88 with an upper run or path length 94. The sprocket 68 and connector path length 92 are disposed directly above the saddle 18 (FIG. 3) to minimize the distance through which a signature is moved from the saddle 18 to the upper run 94 of the conveyor assembly (FIG. 5).

As the pusher finger 62 moves along the connector run or path length 92, it moves along the same path that the signature 40 follows after it has been raised upwardly into the nip 42 by the tucker blade 36. As the pusher finger 62 moves along this path, it passes through a plane which extends perpendicular to a line extending through the axes of rotation of the feed roll 68 and roll segment 46. As the pusher finger 62 continues to move along the connector path length or run 92, it also moves through a plane extending perpendicular to a line through the axes of rotation of the feed roller 68 and presser roller 52.

When the pusher finger reaches the upper run or path length of the conveyor chain 66, the pusher finger engages the trailing edge 60 of the signature on the support plates 56. It should be noted that when the pusher finger moves into engagement with the trailing edge 60 of the signature 40, the signature will still be moving forwardly under the influence of the forces applied to the signature by the feed roll 44. Therefore, there will be a minimum of force applied to the signature upon engagement of the pusher finger 62 with the signature.

When the pusher finger 62 engages the trailing edge of the signature, the trailing edge 60 of the signature is generally perpendicular to the path of movement of the pusher finger 62. This positioning of the signature relative to the pusher finger 62 is assured by the fact that the tucker blade 36 is effective to raise the folded leading edge portion of the signature upwardly into the nip 42 with the folded leading end portion of the signature extending perpendicular to the chains 66. Since the feed roll 44 cooperates with the roll segment 46 and presser rollers 52 to continuously apply a clamping force to the signature to hold it against sidewise or twisting movement, the perpendicular relationship between the leading edge portion of the signature and the conveyor chains 66 is maintained as the signature is moved along the connector run onto the upper run of the conveyor 28.

In order to maintain a registered relationship between the transfer assembly 26, the conveyor assembly 28 and the trimmer mechanism 30, their drives are interconnected in the manner illustrated schematically in FIGS.

Figure 6:
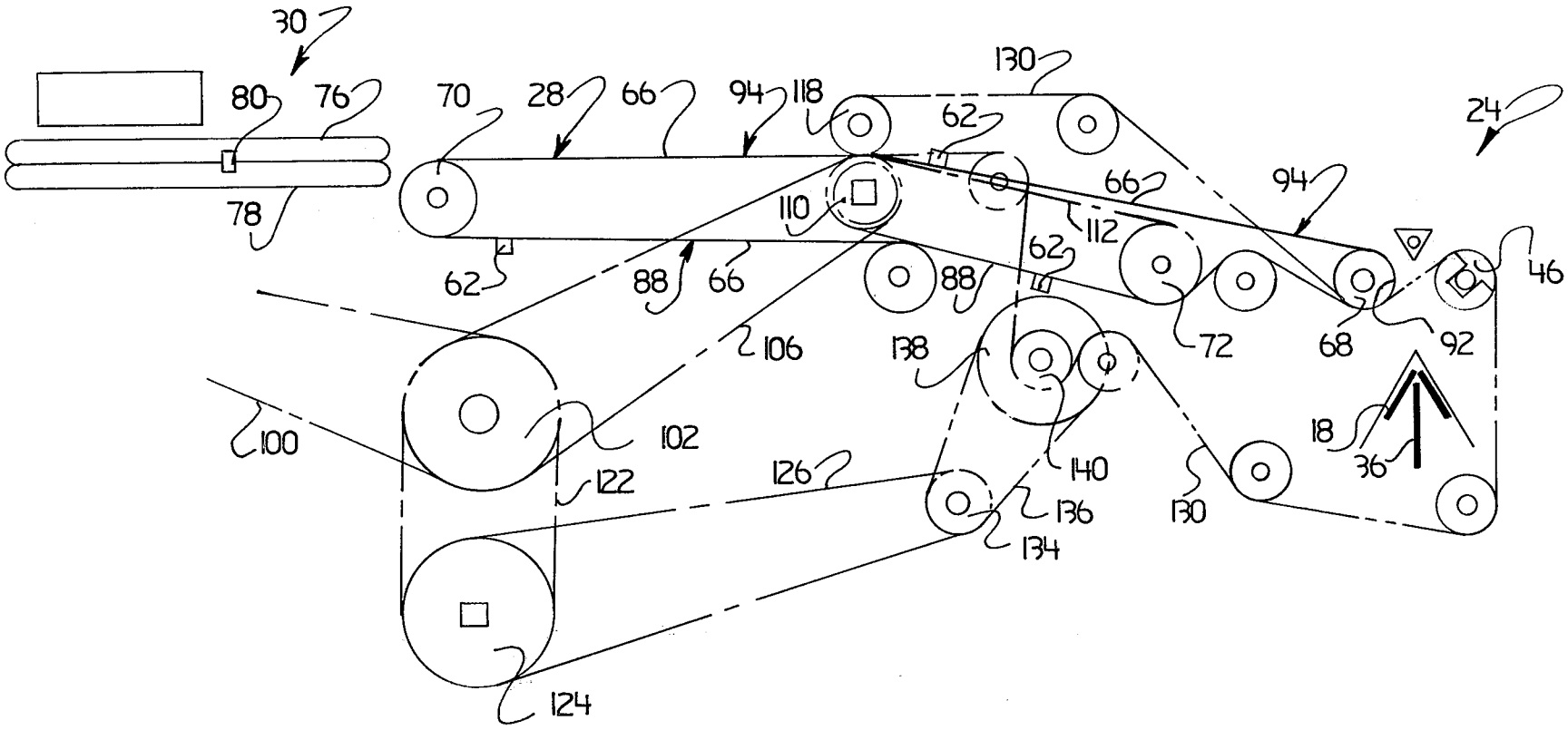
FIG. 6 is a schematic illustration depicting the drive arrangement for the transfer apparatus, the chain conveyor assembly and the trimmer mechanism.
Figure 7:
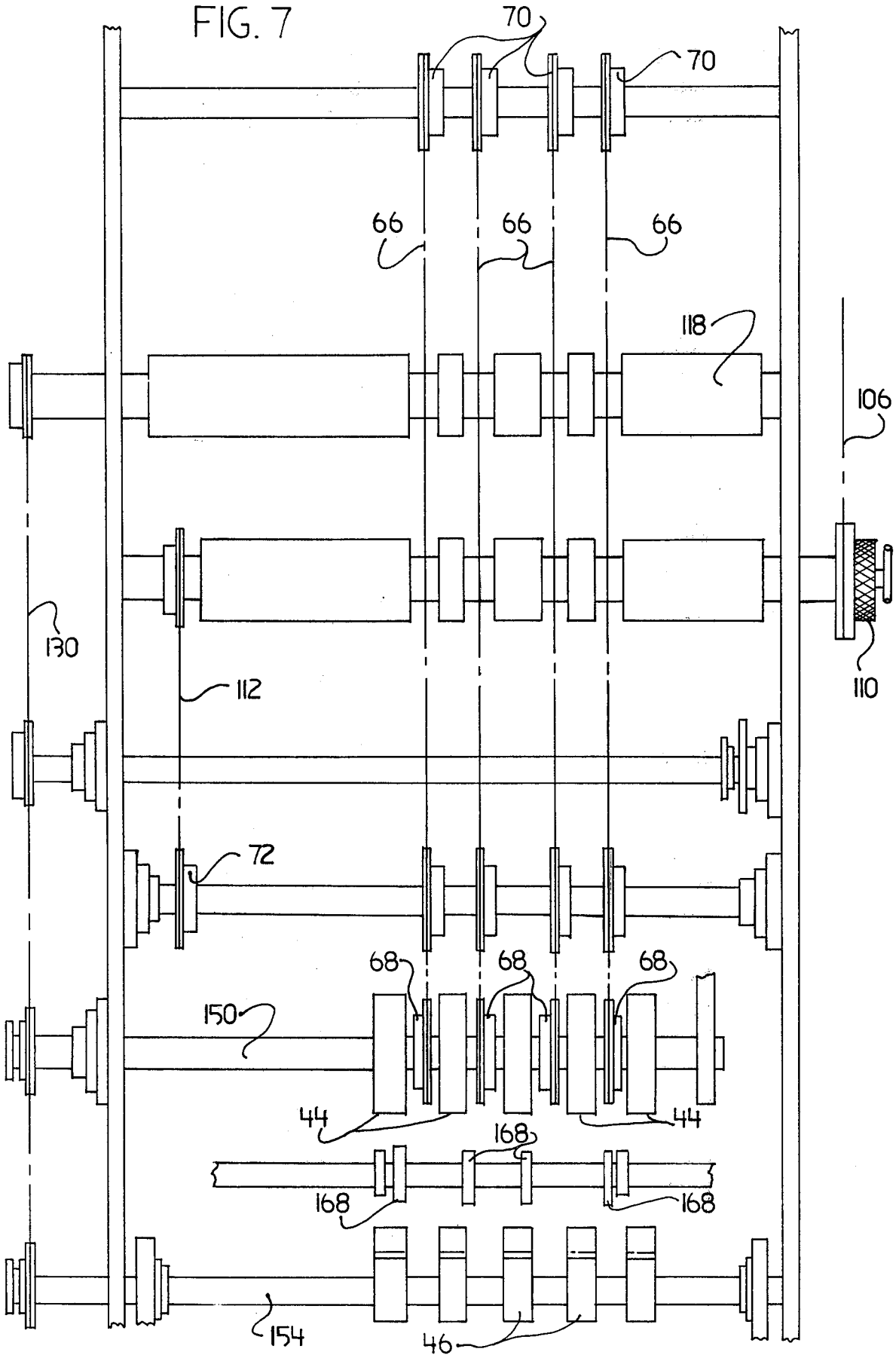
FIG. 7 is a schematic illustration further depicting the drive arrangement for the transfer assembly and the conveyor assembly.

6 and 7. Thus, a trimmer drive chain 100 (FIG. 6) drives a sprocket 102. The sprocket 102 is connected by a chain 106 with a clutch and sprocket assembly 110 (FIGS. 6 and 7). The clutch and sprocket assembly 110 is connected with the conveyor drive sprocket 72 by a chain 112.

During operation of the trimmer mechanism 30, the chains 100, 106 and 112 are effective to drive the conveyor assembly 28 at a speed which varies as a function of variations in the rate of operation of the trimmer mechanism 30. Since the speed of operation of the conveyor assembly 28 varies as a direct function of variations in the speed of operation of the trimmer mechanism 30, the pusher fingers 62 remain in a registered relationship with the operating cycle of the trimmer mechanism.

It is contemplated that when different size signatures are utilized it will be desired to change the spatial relationship between the pusher fingers 62 and the trimmer mechanism 30. This is accomplished by releasing the clutch in the clutch and sprocket assembly 110 (FIG. 6) so that the chain drive sprocket 72 can be rotated to move the conveyor chains 66 without moving the chain 106 and the drive chain 100 from the trimmer. Once the position of the pusher fingers 62 has been adjusted to have the desired relationship with the operating cycle of the trimmer mechanism 30, the clutch in the combination clutch and sprocket assembly 110 is reengaged. Once this has been done, the conveyor chains 66 are driven at a rate which varies as a function of the rate of operation of the trimmer mechanism 30.

The transfer assembly 26 and an upper feed roll 118 (see FIG. 6) are also driven by the drive chain 100 from the trimmer 30 during operation of the trimmer. Thus, drive forces are transmitted from the drive chain 100 to a transfer chain 122. The chain 122 is connected with a combination clutch and sprocket assembly 124 which is effective to drive a chain 126. The chain 126 is connected with a drive chain 130 for the transfer assembly 26 and a feed roll 118 through a sprocket 134, chain 136, sprocket 138 and sprocket 140.

It is contemplated that after the pusher fingers 62 have been registered with the operating cycle of the trimmer mechanism 30, it may be desirable to adjust the transfer assembly 26 relative to the conveyor 28. To accomplish this, a clutch in the combination clutch and sprocket assembly 124 is released so that the drive chain 130 for the transfer assembly 26 can be moved to adjust the transfer assembly 26 without disturbing the relationship between the conveyor assembly 28 and trimmer mechanism 30. Of course, at this time the trimmer mechanism 30 could be operated to drive the conveyor assembly 28 and adjust the positions of the pusher fingers 62 relative to the transfer assembly 26.

The feed rollers 44 (see FIG. 2) are mounted on a shaft 150 in a coaxial relationship with the chain drive sprocket 68. The feed rollers 44 are keyed to the shaft 150 rotate with the shaft. The chain drive sprockets 68 are freely rotatable on the shaft. The drive chain 130 is effective to rotate the feed rollers 44 at a somewhat higher speed than the speed of rotation of the chain sprockets 68. The arcuate roll segments 46 are fixedly mounted on a rotatable shaft 154 which is also driven by the chain 130 at the same speed as the feed rolls 44.

In view of the fact that the feed rolls 44 and roll segments 46 are rotated at a somewhat high speed than the chain sprockets 68, when a signature passes through the nip 42 (FIG. 3) it is accelerated upwardly at a speed which is greater than the speed at which the chains 66 move the pusher fingers 62. This enables the signature 40 to move onto the support plates 56 ahead of the pusher fingers without fear of the pusher fingers overtaking the signature while it is being moved under the influence of the feed roller 44 and roll segment 46. During this movement of the signature 40, the presser rolls 52 are pressed firmly against the signature by springs 160 (FIG. 2) which urge pivotal mounting arms 164 downwardly toward the feed rollers 44 to firmly clamp the signature between the presser rollers 52 and the feed rolls 44.

It is contemplated that during operation of the signature handling apparatus defective signatures may occasionally occur. When this happens, a plurality of divert gates 168 (see FIGS. 2–5) are rotated in a clockwise direction from the position shown in FIGS. 3–5 to divert the defective signature toward the right (as viewed in FIGS. 3–5) into the defective signature receiving tray 32 (see FIG. 1).

Although the transfer assembly 26 is effective to minimize undesirable twisting, slipping and other movements of the signatures during high speed operation of the signature handling apparatus 10, the high speed operation of the apparatus is further promoted by the fact that the signatures 40 move through a relatively short distance in traveling from the saddle 18 to the conveyor assembly 28. Thus, the chain sprockets 68 for the conveyor chains 66 are disposed directly above the saddle 18 so that the tucker blade 36 moves the signature 40 upwardly along a path which extends generally tangentially to the arcuate connector run or path length 92 of the conveyor chains 66. To enable the conveyor chains 66 to be disposed directly above the saddle 18, the shaft 150 on which the sprockets 68 are rotatably mounted is supported between a pair of upright side sections 174 and 176 (see FIG. 1) of the signature handling apparatus 10. With the conveyor chain drive sprocket 68 disposed at the delivery station 24 between the upright support walls or sections 174 and 176 of the signature handling apparatus 10, the chance for twisting and misalignment or jamming of the signatures 40 as they are transferred from the saddle 18 to the conveyor assembly 28 is minimized.

In view of the foregoing description, it is apparent that the present invention provides a new and improved signature handling apparatus 10 which can be operated at very high speeds to transport signatures to a trimmer mechanism 30 without jamming due to twisting or slippage of the signatures. The apparatus 10 includes a transfer assembly 26 which is effective to transfer a signature 40 directly from a saddle 18 to a chain conveyor 28 without the use of belts or tapes to transport the signature. In order to prevent slippage or twisting of a signature, the transfer apparatus 26 positively grips the signature by applying a clamping force to opposite sides of the signature as soon as it begins to leave the saddle. The signature is continuously gripped with a clamping force which is applied to opposite sides of the signature at the nips 42 and/or 50 until the signature is deposited on the chain conveyor 28. The chain conveyor has pusher fingers 62 which engage the trailing edge 60 of the signature and push it to the trimmer mechanism 30.

The transfer of the signatures to the chain conveyor 28 takes place directly above the saddle 18. This minimizes the distance through which the signature must be moved with a resulting reduction in the chances for signature slippage to occur as a signature is transferred from the saddle 18 to the chain conveyor 28. The chain conveyor 28 has upper and lower runs or path lengths 94 and 88 which are interconnected by an arcuate connector run or path length 92. This connector path length 92 is disposed directly above the saddle 18.

As a signature 40 leaves the saddle 18, it is positively gripped by rotatable feed members 44, 46 and 52 and moved along the connector path length 92 onto the upper run 94 of the chain conveyor 28. The trailing edge 60 of the signature is then engaged by a pusher finger 62 which moves the signature along the upper run 94 of the chain conveyor 28 to the trimmer 30. As the signature 40 moves along the upper run of the conveyor 28, the signature is preregistered relative to the trimmer mechanism 30.

Although the conveyor 28 has been described herein as being a chain conveyor having a plurality of chains 66, toothed belts or similar elongated flexible drive members could be utilized to move the pusher fingers 62 if desired. It is also contemplated that toothed belts could be substituted for the drive chain shown in FIGS. 6 and 7 if desired.

Having described one specific preferred embodiment of the invention, the following is claimed:

1. Apparatus for use in handling signatures, said apparatus comprising a saddle extending through a delivery station, means for sequentially moving signatures along said saddle to said delivery station, trimmer means for sequentially trimming signatures, said trimmer means being spaced from said delivery station, conveyor means for transporting signatures to said trimmer means at a first speed, said conveyor means including a plurality of pusher means for sequentially engaging trailing edge portions of the signatures to effect movement and registration of the signatures, elongated flexible drive means for moving each of said plurality of pusher means in turn along an upper run extending from said delivery station toward said trimmer means, a lower run extending away from said trimmer means to said delivery station and a connector run extending between said upper and lower runs, at least a portion of said connector run being disposed directly above said saddle, and transfer means for engaging opposite sides of a signature and transferring the signature at a second speed greater than the first speed away from said saddle to a position where one pusher on said conveyor means may engage same, said transfer means accelerating the signature upwardly at said second speed to a position where the trailing edge portion of the signature is ahead of said one pusher means, said one pusher means engaging the trailing edge of a signature at said position for effecting movement of the signature along said conveyor means.

2. An apparatus as set forth in claim 1 wherein said transfer means includes means for moving the signature along at least part of the portion of the connector run which is disposed directly above said saddle while each of said plurality of pusher means is spaced from a trailing end portion of the signature.

3. An apparatus as set forth in claim 1 wherein said transfer means includes means for sequentially moving leading edge portions of each of the signatures in turn onto the upper run of said conveyor means with the trailing edge portions of the signatures disposed directly above said saddle.

4. An apparatus as set forth in claim 1 wherein said transfer means includes means for gripping opposite side portions of a signature while at least a portion of the signature is in engagement with said saddle and for continuously maintaining gripping engagement with opposite side portions of the signature until the signature is disposed on said conveyor means in position to have said one plurality of pusher means engage the trailing edge portion of the signature.

5. An apparatus as set forth in claim 1 wherein said elongated flexible drive means includes at least one chain which extends from a location directly over said saddle to an inlet to said trimmer means, at least some of said plurality of pusher means being connected with said chain.

6. An apparatus as set forth in claim 1 wherein said transfer means includes a rotatable transfer roll having a circular outer surface and rotatable surface means for cooperating with said circular outer surface of said transfer roll to define a nip through which each signature is moved in turn, each of said plurality of pusher means being movable along a path which extends through a first plane passing through said nip and being disposed in a perpendicular relationship with a second plane containing the axes of rotation of said transfer roll and said surface means.

7. An apparatus as set forth in claim 1 wherein said apparatus further includes a pair of spaced apart and upright support sections, said delivery station being disposed between said support sections, said upper and lower runs of said conveyor means extending from a location between said upright support sections to said trimmer means.

8. An apparatus for use in handling signatures, said apparatus comprising a saddle extending at least part way through a delivery station, means for sequentially moving signatures along said saddle to the delivery station, trimmer means spaced from said delivery station for sequentially trimming signatures, conveyor means for transporting signatures from said delivery station to said trimmer means, said conveyor means including a plurality of pusher means for sequentially engaging trailing edge portions of the signatures, drive means for moving each of said pusher means in turn along an upper path length extending from the delivery station toward said trimmer means, a lower path length extending away from said trimmer means to the delivery station, and a connector path length extending between said upper and lower path lengths, at least a portion of said connector path length being disposed at said delivery station, and transfer means at said delivery station for sequentially transferring signatures from said saddle to said conveyor means to enable said pusher means to engage the trailing edge portions of the signature, said transfer means including signature gripping means for moving each of the signatures in turn upwardly from the saddle and then along at least a portion of said connector path length, for applying a clamping force against opposite side portions of each of the signatures in turn to firmly grip the signatures while lower end portions of the signatures are disposed in engagement with the saddle, and for maintaining a clamping force at all times on opposite side portions of the signatures while each of the signatures is moved in turn from said saddle to said conveyor means.

9. An apparatus as set forth in claim 8 wherein said signature gripping means includes a rotatable transfer roll having a circular outer surface and rotatable surface means for cooperating with said circular outer surface of said transfer roll to define a nip through which each signature is moved in turn said drive means for said pusher means comprising at least a pair of laterally spaced continuous chains which partially encircle chain sprockets, said transfer roll and chain sprockets being mounted coaxially, each of said pusher means being movable along a path which extends through a first plane passing through said nip and being disposed in a perpendicular relationship with a second plane containing the axes of rotation of said transfer roll and said surface means.

10. An apparatus as set forth in claim 9 wherein said connector path length has an arcuate configuration and a center of curvature which is disposed on the axis of the rotation of said transfer roll.

* * * * *